US010486888B2

(12) United States Patent
Wooldridge et al.

(10) Patent No.: US 10,486,888 B2
(45) **Date of Patent: *Nov. 26, 2019**

(54) VACUUM COOLER

(71) Applicant: HEB Grocery Company, LP, San Antonio, TX (US)

(72) Inventors: Eric Newland Wooldridge, Stanford, KY (US); Daniel Bailey Jacobs, Stanford, KY (US)

(73) Assignee: HEB GROCERY COMPANY, LP, San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/393,844

(22) Filed: Apr. 24, 2019

(65) Prior Publication Data

US 2019/0248571 A1 Aug. 15, 2019

Related U.S. Application Data

(63) Continuation of application No. 15/897,348, filed on Feb. 15, 2018, which is a continuation of application (Continued)

(51) Int. Cl.

| | |
|---|---|
| ***B65D 81/38*** | (2006.01) |
| ***B65D 81/30*** | (2006.01) |
| *B65B 31/04* | (2006.01) |

(52) U.S. Cl.

CPC ..... *B65D 81/3813* (2013.01); *B65D 81/30* (2013.01); *B65D 81/3818* (2013.01); *B65B 31/04* (2013.01)

(58) Field of Classification Search

CPC ..... B65D 81/30; B65D 81/3813; B65D 81/3818; B65B 31/04

(Continued)

(56) References Cited

U.S. PATENT DOCUMENTS

| | | | |
|---|---|---|---|
| 1,541,945 | A | 6/1925 | Hamilton |
| 2,173,571 | A | 9/1939 | Jesnig |

(Continued)

FOREIGN PATENT DOCUMENTS

| | | | |
|---|---|---|---|
| CN | 2214928 | Y | 12/1995 |
| EP | 0097443 | A1 | 1/1984 |

(Continued)

OTHER PUBLICATIONS

Sunbeam, FoodSaver VS0630, "How to Open the FoodSaver (R) Canister", taken from the Internet on Apr. 15, 2014 ram: https://www.sunbeam.eom.au/Root/Specifications/InstructionBookleWS0630_ib_1.pdf, p. 11, 2011.

(Continued)

*Primary Examiner* — Andrew T Kirsch
*Assistant Examiner* — Elizabeth J Volz
(74) *Attorney, Agent, or Firm* — Perkins Coie LLP

(57) ABSTRACT

A cooler capable of achieving a sufficient temperature gradient between an inside of the cooler and an outside of the cooler such that at least a partial vacuum forms within the cooler may include an enclosure defined by at least one wall and a lid. The lid may form a relatively airtight seal with a wall of the cooler when in a closed position. A vacuum release assembly may be disposed in one of the walls or lid of the cooler, the assembly being capable of reducing a pressure differential between the enclosure and the outside of the cooler.

20 Claims, 5 Drawing Sheets

Related U.S. Application Data

No. 15/046,919, filed on Feb. 18, 2016, now Pat. No. 9,932,165, which is a continuation of application No. 13/562,828, filed on Jul. 31, 2012, now Pat. No. 9,296,543.

(58) Field of Classification Search
USPC ..... 220/592.01, 592.11, 592.02, 592.09, 220/DIG. 18, 592.27, 231
See application file for complete search history.

(56) References Cited

U.S. PATENT DOCUMENTS

| | | | | |
|---|---|---|---|---|
| 3,133,664 | A | 5/1964 | Koch | |
| 3,487,973 | A | 1/1970 | Wachter | |
| 4,046,163 | A | 9/1977 | Novak | |
| 4,149,650 | A | 4/1979 | Whelchel et al. | |
| 4,200,259 | A | 4/1980 | Ueda | |
| 4,490,597 | A | 12/1984 | Mengel | |
| 4,498,312 | A | 2/1985 | Schlosser | |
| 4,537,044 | A | 8/1985 | Putnam | |
| 4,573,202 | A | 2/1986 | Lee | |
| 4,821,907 | A | 4/1989 | Castles et al. | |
| 4,872,589 | A | 10/1989 | Englehart et al. | |
| 5,064,088 | A | 11/1991 | Steffes | |
| 5,397,024 | A | 3/1995 | Wu et al. | |
| 5,568,735 | A | 10/1996 | Newkirk et al. | |
| 5,570,588 | A | 11/1996 | Lowe | |
| 5,671,611 | A | 9/1997 | Quigley | |
| 6,003,719 | A * | 12/1999 | Stewart, III ..... | B65D 81/3825 220/592.11 |
| 6,206,220 | B1 | 3/2001 | Stodd | |
| 6,295,830 | B1 | 10/2001 | Newman | |
| 6,510,946 | B2 | 1/2003 | Gutierrez et al. | |
| 6,644,489 | B2 | 11/2003 | Chang | |
| 6,698,608 | B2 | 3/2004 | Parker et al. | |
| 6,789,690 | B2 | 9/2004 | Nich et al. | |
| 6,953,126 | B2 | 10/2005 | Parker et al. | |
| 7,296,598 | B2 | 11/2007 | Lin et al. | |
| 9,139,352 | B2 | 9/2015 | Seiders et al. | |
| 9,296,543 | B2 | 3/2016 | Wooldridge et al. | |
| 9,932,165 | B2 * | 4/2018 | Wooldridge ..... | B65D 81/3818 |
| 2007/0000396 | A1 | 1/2007 | Kieck | |
| 2008/0164265 | A1 | 7/2008 | Conforti | |
| 2009/0120939 | A1 | 5/2009 | Wang | |
| 2009/0188916 | A1 | 7/2009 | Daviau | |
| 2010/0084307 | A1 | 4/2010 | Yeghiayan et al. | |
| 2010/0270304 | A1 * | 10/2010 | Chen ..... | B65D 43/022 220/231 |
| 2014/0003465 | A1 | 2/2014 | Wooldridge et al. | |
| 2016/0015955 | A1 | 6/2016 | Wooldridge et al. | |
| 2018/0017065 | A1 | 6/2018 | Wooldridge et al. | |

FOREIGN PATENT DOCUMENTS

| | | | |
|---|---|---|---|
| KR | 20000027305 | A | 5/2000 |
| WO | 2008018730 | A1 | 2/2008 |

OTHER PUBLICATIONS

Yeti Coolers "http://www.yeticoolers.com/categories/Tundra-Series/" (2011), accessed Apr. 23, 2019, (22 Pages).

* cited by examiner

VACUUM COOLER

CROSS REFERENCE TO RELATED APPLICATIONS

The present application is a continuation of Ser. No. 15/897,348, entitled "Vacuum Cooler" and filed on Feb. 15, 2018, which is a continuation of Ser. No. 15/046,919, entitled "Vacuum Cooler" and filed on Feb. 18, 2016, now U.S. Pat. No. 9,932,165, which is a continuation of U.S. patent application Ser. No. 13/562,828, entitled "Vacuum Cooler" and filed on Jul. 31, 2012, now U.S. Pat. No. 9,296,543, which are hereby incorporated by reference in their entireties for all purposes.

BACKGROUND OF THE INVENTION

1. Field of Invention

This invention relates to an improved container for holding beverages, food, and other items that require lengthy storage time with reduced heat gain or loss while maintaining freshness when no power source is available for refrigeration or heating.

2. Description of the Prior Art

Beverages, food, medical supplies, drugs and other heat sensitive products requiring storage without a power source have generally been stored in insulated coolers or ice chests for a very limited time period. Although these coolers or chests have certainly evolved over the years, for instance, U.S. Pat. No. 5,671,611 to Quigley dated Sep. 30, 1997, U.S. Pat. No. 5,568,735 to Newkirk dated Oct. 29, 1996, and U.S. Pat. No. 4,872,589 to Englehart dated Oct. 10, 1989. These all address the issue of preventing melted ice from coming into contact with the contents of the cooler allowing the contents to become soggy. Though each of the aforementioned patents provides a solution to the expressed problem of preventing melted ice from coming into contact with the contents of the cooler, it in no way prolongs the effectiveness of a cooler by keeping the contents' ambient temperature maintained for longer periods of time. The above patents address no efficient way of reducing the effects of radiant, convective or conducive heat, nor do they remove the decomposition effects of oxygen from the product storage area.

In U.S. Pat. No. 4,537,044 to Putnam dated Aug. 27, 1985 a more effective hot or cold food storage container is described which could take advantage of the physical movement of heat or cold. This container is designed so that a cooling source is above the food storage compartment for transferring cold in a descending direction while in cooling mode. A heat source is placed below the storage compartment for transferring heat in an ascending direction while in heating mode. Though this invention attempts to improve the effectiveness of a cooler it does not minimize the effects of radiation, nor does it eliminate conductive and convective heat while removing the decomposition effects of an oxygen environment by creating a vacuum in the product storage area.

Another invention described in U.S. Pat. No. 4,498,312 to Schlosser dated Feb. 12, 1985, which is designed to maintain hot or cold temperatures through use of solution filled slab-like panels. The slab-like panels, which provide the source of heat or cold, must be frozen or heated by an external source such as a freezer or oven. While the proposed invention could also incorporate cooling panels filled with water instead of a solution or ice, the above patent makes no use of a radiant barrier or a vacuumed containment area to prolong the desired temperature and maximize the freshness of the product.

U.S. Pat. No. 5,570,588 to Lowe dated Nov. 5, 1986 also uses solution filled slab-like panels or gel packs to maintain product at desired temperature. Again this patent makes no mention of minimizing radiant, conductive, and convective heat through the use of a vacuum sealed container nor does it remove the detrimental effects of oxygen.

The picnic cooler described in U.S. Pat. No. 5,064,088 to Steffes dated Nov. 12, 1991 incorporates a new lid design. The purpose of this cooler design is to improve the method of operating the cooler by allowing access to the container body in multiple ways without the use of hinges or latches. This invention is not intended to improve the efficiency of the cooler in the fact that it does not maintain the stored products' ambient temperatures.

U.S. Pat. No. 6,003,719 dated Dec. 21, 1999 to John R. Stewart III. Stewart sets out to improve the efficiency of the cooler by including radiant heat barrier and air space between an inner and an outer shell. While this design does a good job at reducing radiant heat, the described air barrier between the inner and outer shell is far less efficient at reducing conductive and convective heat than removing air molecules all together. In comparison, by removing the air molecules the proposed invention creates a far superior container while simultaneously removing the decomposing effects of oxygen this not only keeps products cold for longer periods of time, but it also maintains freshness.

U.S. Pat. No. 6,295,830 dated Oct. 2, 2001 to Michael D. Newman descries a tote for transporting refrigerated or frozen goods comprising an insulated container and a coolant insert. The insulated container includes a durable, impact-resistant shell, an insulation insert, an optional corrugated liner, and a cover. In this patent Newman has simply created a different form of coolant from which the container depends. This patent makes no mention of minimizing conductive and convective heat through the use of a vacuum sealed container nor does it remove the detrimental effects of oxygen.

U.S. Pat. No. 6,510,946 dated Jan. 28, 2003 to Gena Gutierrez and Javier Gutierrez describes a vacuum Insulated Lunch Box with a rectangular box comprised of a top half and a bottom half, the top half and bottom half each having a double wall construction, and both having recessed areas to accommodate a plurality of food containers. Additionally, the top half and bottom half each having an outlet check valve, and the valves are capable of receiving a tube from a vacuum pump for the purpose of evacuating the cavity of each said lunch box half. A preferred embodiment includes further comprising a built in vacuum pump. In this invention Gena and Javier have employed the use of a vacuum to insulate a small lunch box that can contain no more than a day's meal instead of a cooler that is intended for long trips to sustain a large volume of products and not limited to food or beverages, furthermore, their patent has to create two separate vacuums in two separate compartments to maintain hot food and a cold beverage. The above mentioned patent makes no use of a radiation reflecting material and only addresses two out of three beat transfer modes. Since the food must be first put in to a container prior to being stored in the lunch box, it in no way prolongs freshness, since the vacuum space is separate from the storage areas and thus oxygen is still present where the food is actually stored.

OPERATION OF THE INVENTION

Radiation is unique and independent form of heat transfer that basically refers to the transmission of electromagnetic energy through space. Infrared rays are not themselves hot but are simply a particular frequency of pure electromagnetic energy. Heat does not occur until these rays strike an object, thereby increasing the motion of surface molecules. The heat then generated is spread to the interior of the object through conduction. The radiation reflective material works by reflecting these infrared rays away from the interior of the cooler, thus reducing radiant heat in the containment or product storage area.

While reducing radiant heat contributes to the reduction of heat transfer, it does not address the effects of conductive or convective heat. Heat conduction, also called diffusion, is the direct microscopic exchange of kinetic energy of particles through the boundary between two systems. When an object is at a different temperature from another body or its surroundings, heat flows so that the body and the surroundings reach the same temperature, at which point they are in thermal equilibrium. Such heat transfer always occurs from a region of high temperature to another region of lower temperature, as described by the second law of thermodynamics. On a microscopic scale, heat conduction occurs as hot, rapidly moving or vibrating atoms and molecules interact with neighboring atoms and molecules, transferring some of their energy (heat) to these neighboring particles. In other words, heat is transferred by conduction when adjacent atoms vibrate against one another, or as electrons move from one atom to another. Conduction is the most significant means of heat transfer within a solid or between solid objects in thermal contact and convection is usually the dominant form of heat transfer in liquids and gases, based on the phenomena of movement between fluids. Basically, a moving fluid or gas transfers more energy to another substance or object when it is moving around it rather than being stationary.

By creating a substantial vacuum in the cooler the stored product's capacity to transfer or receive energy via conduction or convection thru air molecules is substantially limited due to the fact that there are no longer air molecules in the vicinity of the stored products to facilitate such a transfer.

Air consists of 78% nitrogen, 21% oxygen, and a 1% mixture of other gases. While oxygen is essential for life, it can have deteriorative effects on fats, food colors, vitamins, flavors, and other food constituents. Basically, oxygen can cause food spoilage in several ways; it can provide conditions that will enhance the growth of microorganisms; it can cause damage to foods with the help of enzymes; and it can cause oxidation. Molds and most yeast that cause food to spoil require oxygen to grow. By creating a substantial vacuum in the cooler assembly the detrimental effects of an oxygen rich environment are greatly reduced due to the fact that oxygen is no longer present.

DRAWING FIGURES

The invention will be best understood, together with additional advantages and objectives thereof, from the following descriptions, read with reference to the drawings in which.

DRAWING REFERENCE NUMERALS

Figure 1:
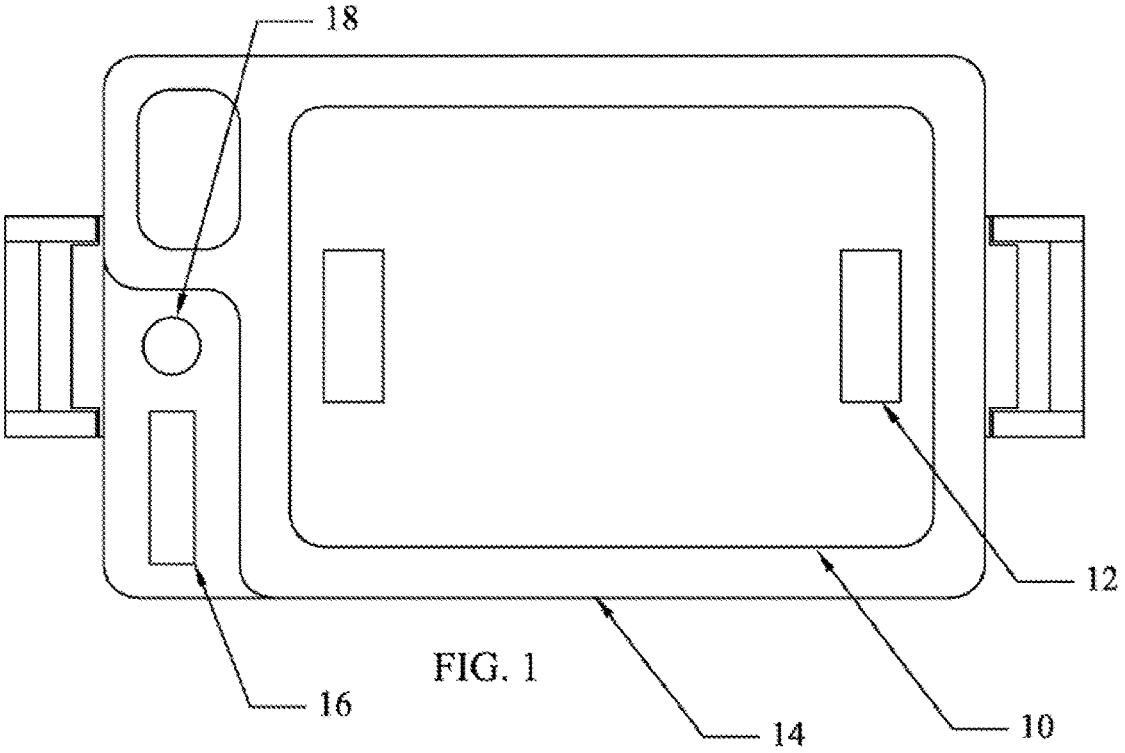
FIG. 1 is a top view of a cooler constructed according to the teachings of the present invention.

10 cooler lid assembly
12 cooler lid gripping handles
14 cooler assembly
16 vacuum pump handle
18 vacuum release button
20 radiation reflecting material
22 cooler assembly handle
24 perforated interior shell wall
26 perforating holes
28 perforated cooler lid shell wall
30 seal
32 vacuum pump assembly
34 vacuum pump exhaust
36 vacuum pump intake
38 spring
40 plunger
42 outside air exhaust
44 outside air intake
46 plunger shaft
48 vacuum release assembly
50 exterior shell
52 perforated reinforcement member
54 product storage area
56 vacuum space
58 non perforated shell wall

DESCRIPTION OF INVENTION

Various embodiments of the invention are described by reference to the drawings in which like numerals are employed to designate like parts. Various items of equipment that could be additionally employed to enhance functionality and performance such as fittings, mountings, sensors (e.g. temperature gages), etc., have been omitted to simplify the description. However, such conventional equipment and its applications are known to those of skill in the art, and such equipment can be employed as desired. Moreover, although the invention is described below in the context of the transport and storage of products that are sensitive to heat transfer and degradation due to oxygen present atmosphere, those skilled in the art will recognize that the invention has applicability to the transport and/or storage of many different refrigerated or frozen products or items, e.g. medical supplies, biological material, chemicals, and the like.

Figure 2:
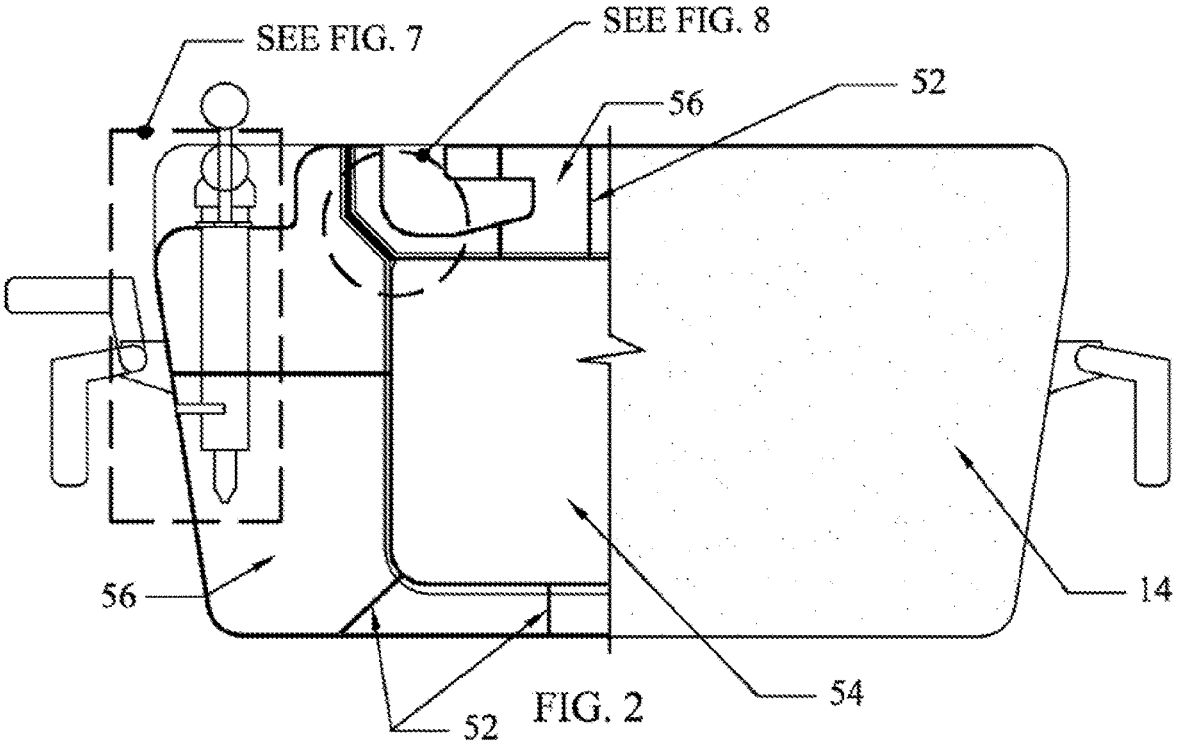
FIG. 2 is a front view of a cooler constructed according to the teachings of the present invention with portions being broken away to illustrate the interior construction of the cooler.

FIGS. 1 and 2 describe one embodiment of the cooler assembly, designated 14 of this invention that may be used to store products longer, maintain freshness, and substantially decrease the amount of heat transfer between the products and the outside environment. The cooler assembly is shown in a rectangular configuration, but can be of any convenient shape and composed of appropriate material(s) with regards to thermal transfer, weight, and strength. The cooler lid assembly designated 10, seals the cooler assembly by means of location and vacuum suction. The cooler lid assembly likewise is shown in a rectangular configuration but can also be of any convenient shape to match that of the cooler assembly 14. Typically the cooler and lid assemblies 14 and 10 can be shaped and sized to accommodate products for which they are designed. The cooler lid assembly 10 is manually placed or removed by the user by means of gripping handles designated 12. The cooler assembly 14 and cooler lid 10 are then depressurized by the user by the means of the pumping of the vacuum pump handle designated 16. This depressurization likewise seals the cooler lid 10 to the cooler assembly 14. The vacuum release button designated 18 is then pressed by the user to re-pressurize the cooler assembly 14 and the cooler lid 10, allowing the user to then remove the lid by the gripping handles 12 due to the fact that the suction seal between the cooler assembly 14 and the cooler lid 10 has been neutralized. The cooler and lid assemblies 14 and 10 are constructed of such materials to be light, durable, and to minimize thermal conductance.

Figure 7:
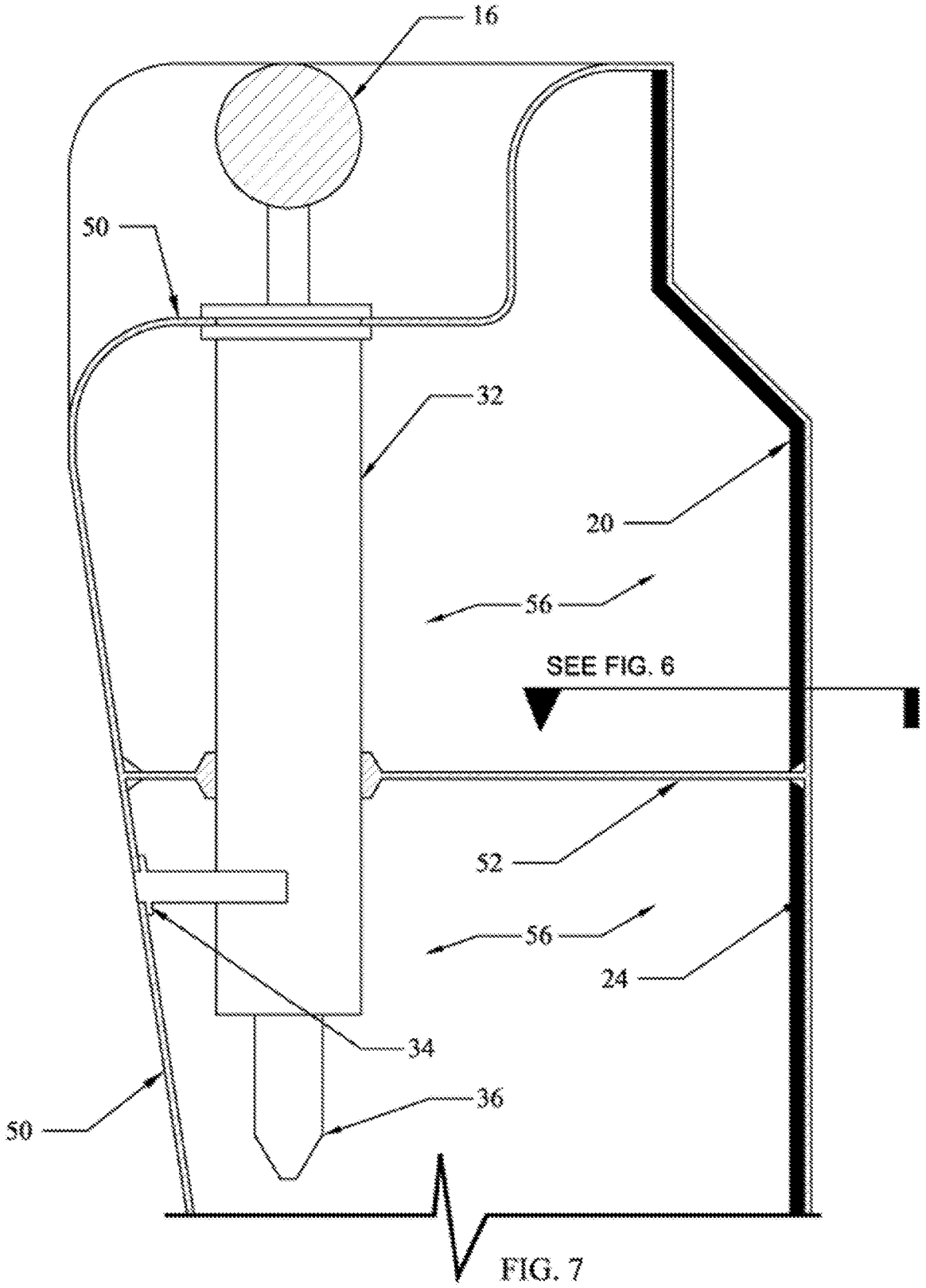
FIG. 7 is an enlarged sectional view taken from FIG. 2 showing the assembly of the vacuum pump assembly and cooler housing assembly interface and details of a cooler constructed according to the teachings of the present invention.

Referring to FIG. 7 showing an enlarged sectional view of the interior of the cooler assembly 14, the stored products experience substantially less heat transfer as a result of both the removal of air molecules, by manipulation of the vacuum pump assembly designated 32, from the cooler assembly 14 and the cooler lid assembly 10, which greatly reduces convection and conduction. Stored products likewise experience less heat transfer due to radiation from the reflecting of that radiation by the radiation reflecting material designated 20. The vacuum pump assembly 32, is manipulated by the user by means of the vacuum pump handle 16. The vacuum pump assembly is rigidly fixed connected to the cooler assembly 14 to both the exterior shell designated 50 and the perforated reinforcement member(s) designated 52. The vacuum pump assembly 32 when manipulated by the user depressurizes the cooler assembly 14 and the cooler lid assembly 10 by removing air from the vacuum space(s) designated 56 through the vacuum pump intake designated 36 and exhausting the air to the outside environment through the vacuum pump exhaust designated 34 which penetrates the exterior shell 50. Likewise the stored products are shielded from the effects of heat transfer associated with radiation by the radiation reflecting material 20 that is laminated to the perforated interior shell wall(s) designated 24. The perforated reinforcement members 52 that are shown throughout the cooler assembly 14 and the cooler lid assembly 10 provide resistance to deformation and rupture of both assemblies as a result of loads generated by stored product(s) weight, exterior impact, depressurization, and other environmental loads, but allow air to flow from both assemblies into the vacuum pump intake 36.

Figure 3:
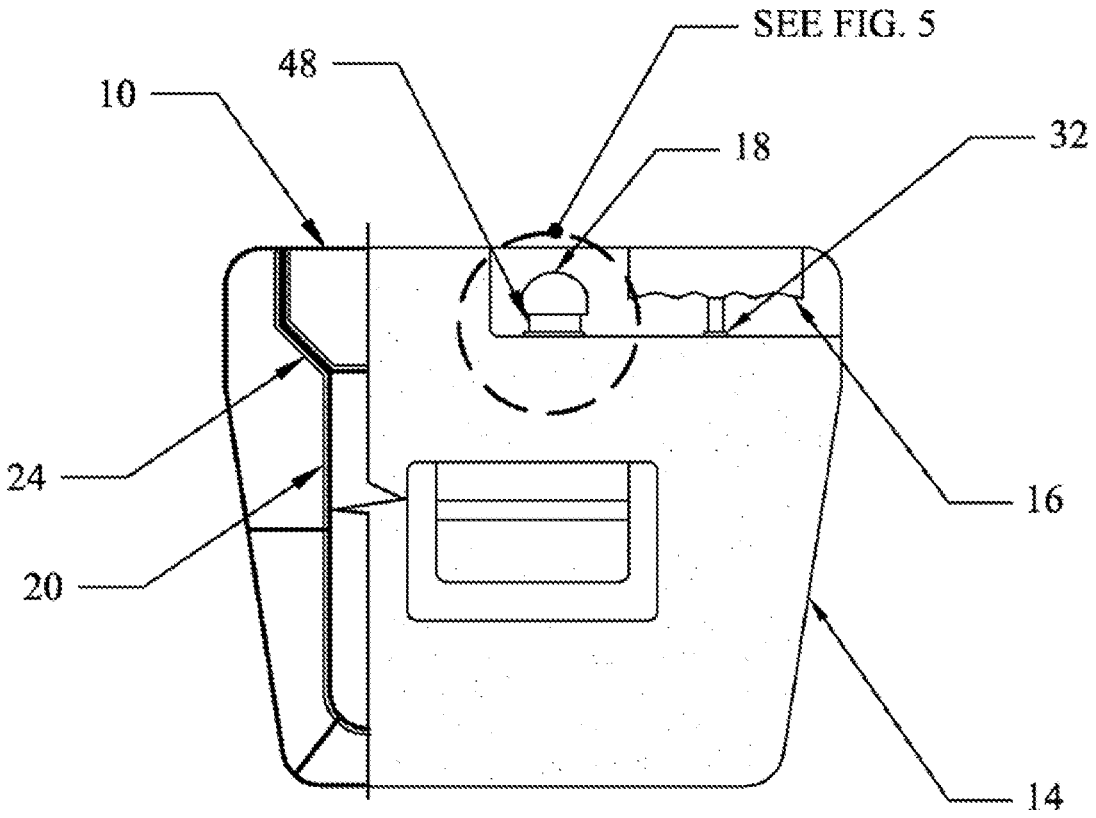
FIG. 3 is a side view of a cooler constructed according to the teachings of the present invention with portions being broken away to illustrate the interior construction of the cooler.
Figure 4:
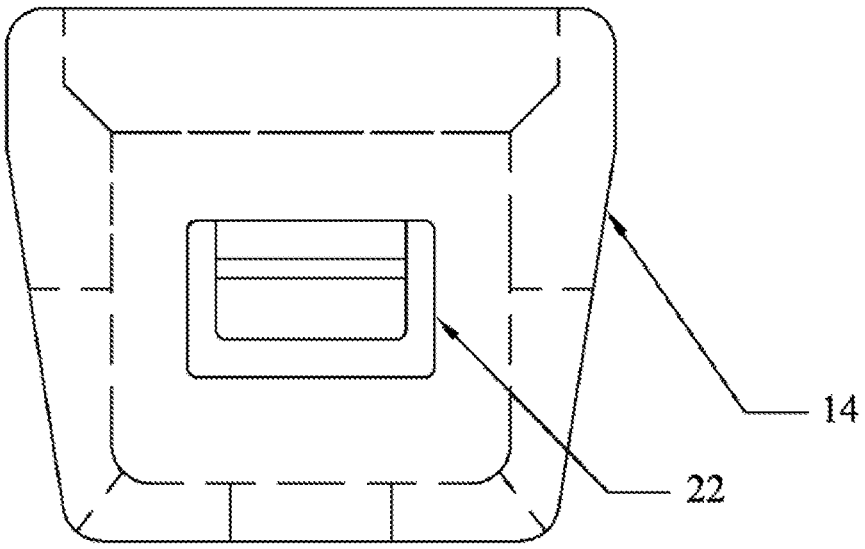
FIG. 4 is a side view of a cooler constructed according to the teachings of the present invention.

FIGS. 3 and 4 describe embodiments of the cooler and lid assemblies 14 and 10 in closed configuration with a partial section view describing the interior construction of both. The assemblies are in many respects constructed similarly to the prior art. Accordingly, an exterior mounted cooler assembly handle(s) designated 22 is manipulated by the user to lift the cooler assembly 14 and can be substituted with various embodiments true to the intent of the function. The vacuum release button 18 is located adjacent to the vacuum pump handle 16 for convenience however, can be located at any convenient location on the cooler assembly 14. The vacuum release assembly 48 which is used to re-pressurize the cooler assemblies 14 and 10, and is embodied as a manually manipulated device, can be of any convenient design or configuration, including that of alternate mechanical or electronic mechanisms. Likewise, the embodiment of the vacuum pump assembly 32, can be of any convenient design or configuration, including that of alternate mechanical or electronic mechanisms. FIG. 4 describes the basic shape of the cooler assembly 14 in the representation as dashed lines of the interior bottom and side walls, exterior walls, bottom and top surfaces, and perforated reinforcement members 52 throughout the assembly. FIG. 3 also demonstrates the continuous lamination of the radiation reflecting material 20 throughout the assemblies to completely shield store products from the effects of heat transfer from radiation, specifically along all side walls, the interior face of the cooler lid assembly 10, and along the interior bottom face of the cooler assembly 14.

Figure 5:
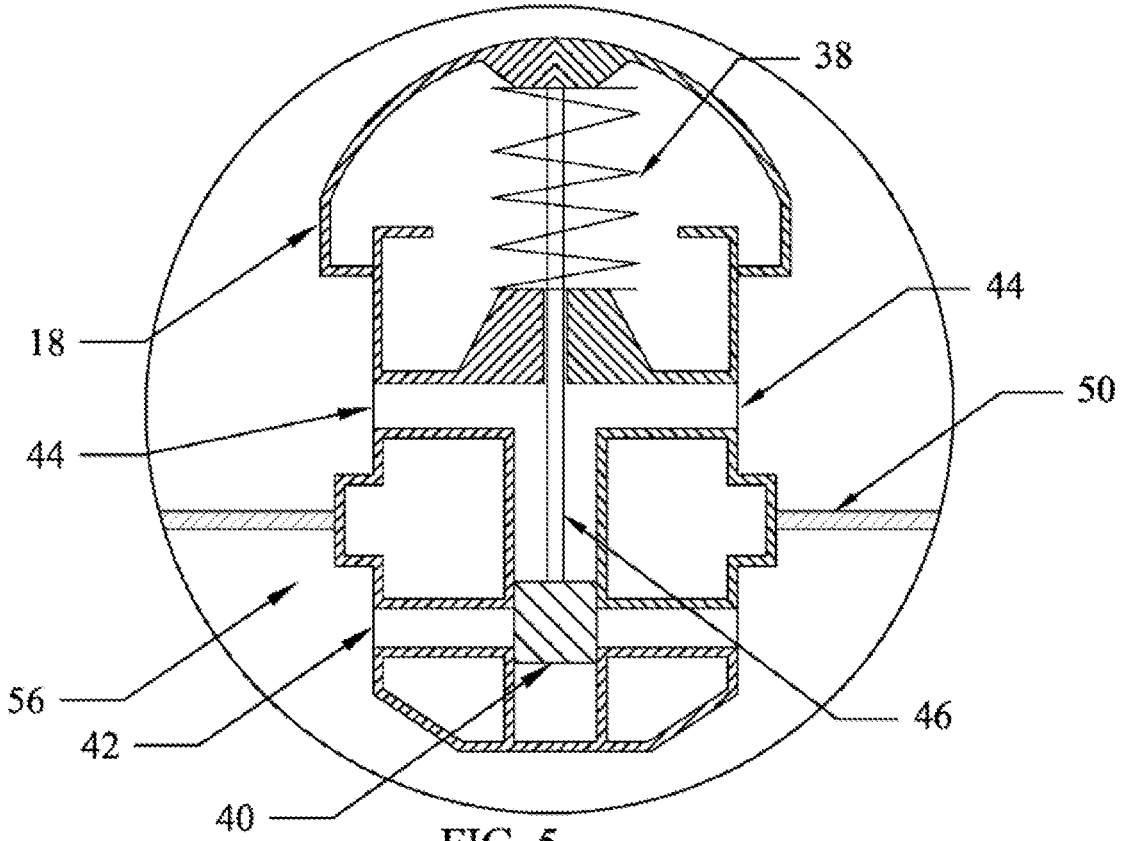
FIG. 5 is an enlarged sectional view taken from FIG. 3 showing the vacuum release valve interface and its internal details according to the teachings of the present invention.

FIG. 5 describes in a sectional view the embodiment of the vacuum release assembly in its manual conceptual function and can be of any convenient configuration or alternate mechanical or electrical mechanism. The described function consists of the use of the plunger designated 40 to provide an air stop from the openings within the assembly noted as outside air exhaust designated 42 and the outside air intake designated 44. When the user has depressurized the cooler assemblies 14 and 10, the vacuum release assembly stops air from the outside environment, driven by the external/internal pressure differential, from re-entering the cooler assemblies by means of force applied by the spring designated 38 to the plunger shaft designated 46. At the point in which the user wishes to re-pressurize the cooler assemblies 14 and 10, the user will apply force to the vacuum release button 18 which combined with atmospheric pressure will overpower the spring 38 and allow the plunger 40 to move downward and provide an opening for air to enter the vacuum space and neutralize the pressure differential.

Figure 6:
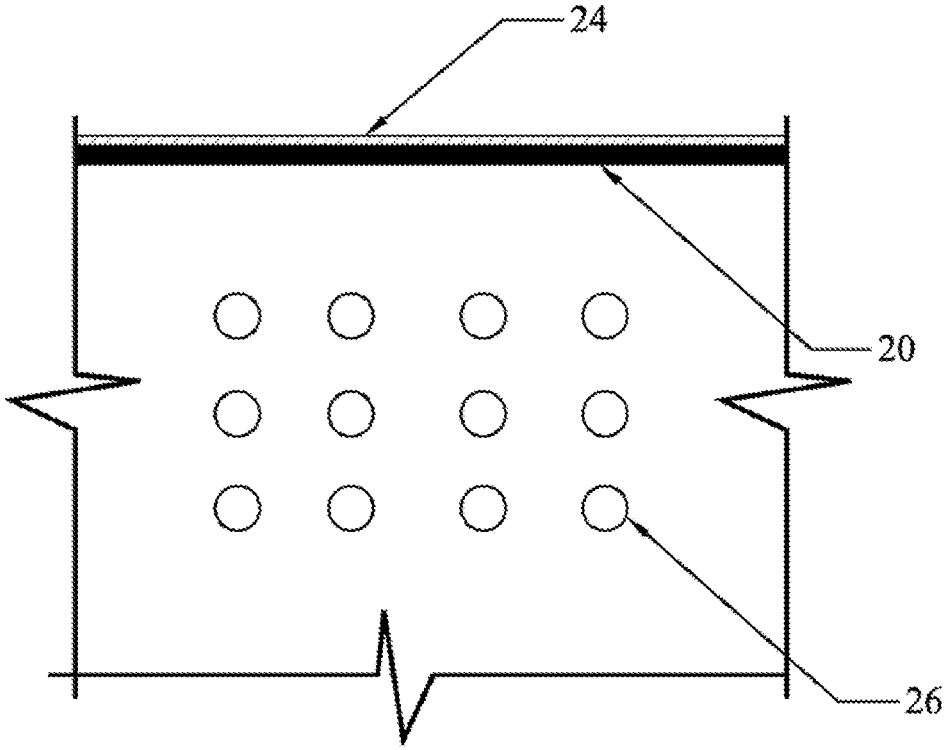
FIG. 6 is an enlarged sectional view taken from FIG. 7 showing the details of the perforated reinforcement member according to the teachings of the present invention.

FIG. 6 illustrates an example view of a perforated reinforcement member 52 detailing the perforating holes designated 26 use to allow air flow through the reinforcing member, thereby allowing the member to strengthen the assemblies 14 and 10 but not to impede the creation of a vacuum within the assemblies 14 and 10. The perforating hole(s) 26 may be of any convenient shape and size without reducing the necessary strength of the member.

Figure 8:
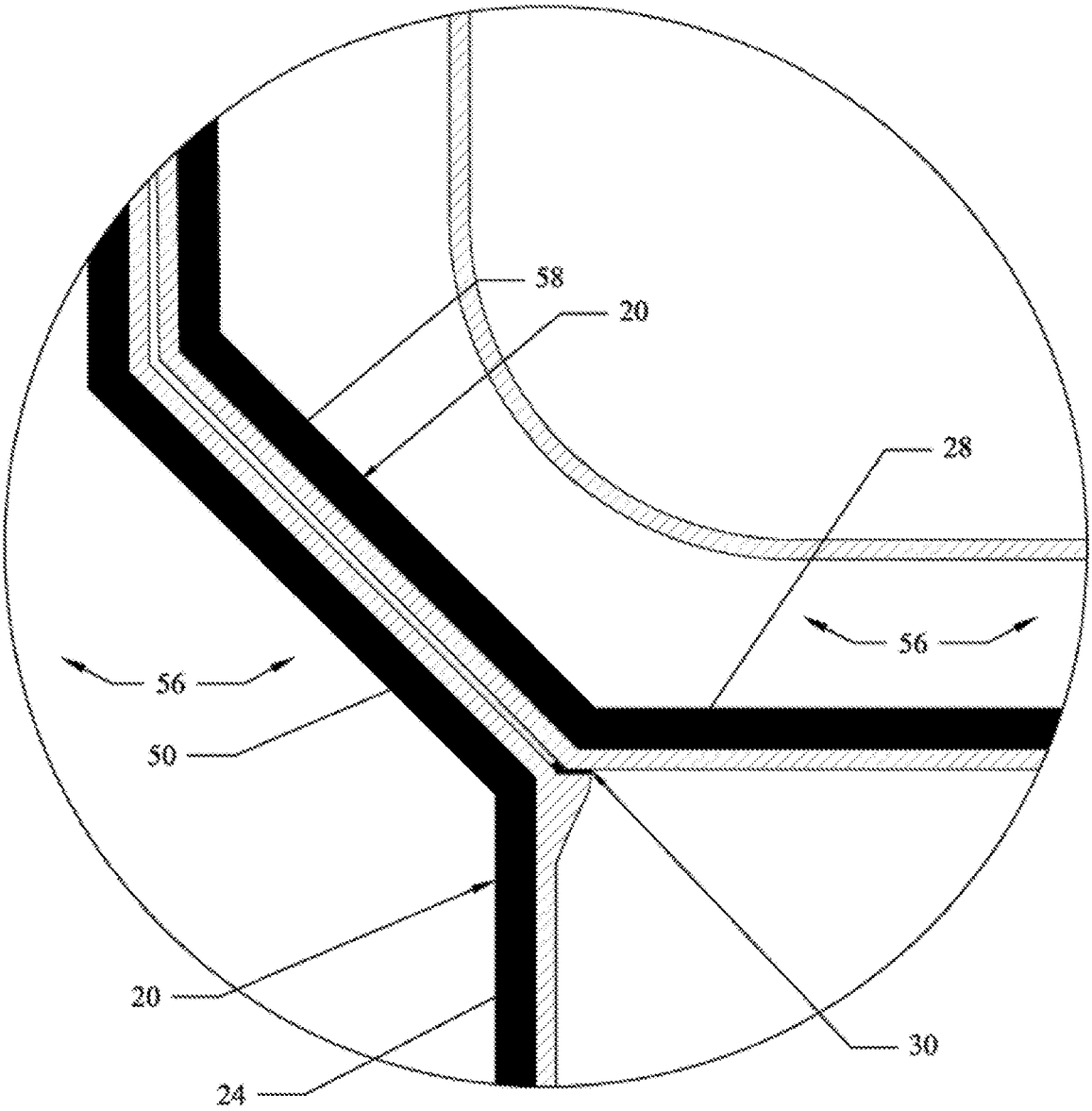
FIG. 8 is an enlarged sectional view taken from FIG. 2 showing the lid assembly and cooler housing assembly interface and details of a cooler constructed according to the teachings of the present invention.

FIG. 8 illustrates an enlarged sectional view of the functional mating connection between the cooler assembly 14 and the cooler lid assembly 10. The perforated cooler lid shell wall 28 rests on the seal designated 30 within the opening shape provided by the cooler assembly 14. Wall and shell construction of both the cooler and lid assemblies 14 and 10 beyond that of the seal 30 where the surfaces could be exposed to the environment are no longer perforated as illustrated by the component changes of the non-perforated shell wall designated 58 and the exterior shell 50. The continuous seal 30 itself is of some appropriate material relative to its function and rests on a continuous ledge or extrusion from the perforated interior shell wall 24.

When the user depressurizes the cooler assemblies 14 and 10 the resulting suction force generated by the pressure differential between the outside environment and the vacuum space 56 will cause the cooler lid assembly 10 to be forcibly sealed to its point of contact with the seal 30, thus creating a locking force that will be maintained until the user re-pressurizes the assemblies 14 and 10.

What is claimed is:

1. A cooler comprising:

an enclosure and a lid to surround a product storage area within the enclosure, the lid forming a seal with a top section of the enclosure surrounding the product storage area of the cooler when the lid is in a closed position due to a pressure differential between an interior of the cooler and an exterior of the cooler, wherein the lid and the enclosure are insulated, and wherein the enclosure is capable of maintaining a temperature differential between the interior of the enclosure and the exterior of the enclosure; and a pressure release assembly disposed in at least one side of the enclosure, the pressure release assembly being capable of neutralizing the pressure differential, wherein the pressure release assembly comprises:

an outside air exhaust or intake channel through which outside air may enter the enclosure, a plunger including a shaft, the plunger selectively movable with respect to an opening at one end of the outside air exhaust or intake channel to allow air from the exterior of the cooler to enter the enclosure through the opening, and a pressure release button coupled to the plunger.

2. The cooler of claim 1, wherein the air from the exterior of the cooler is able to enter into the outside air exhaust or the intake channel through at least one side opening on a side of the outside air exhaust or intake channel.

3. The cooler of claim 1, wherein the plunger is configured to provide an air stop at the opening within the pressure release assembly.

4. The cooler of claim 1, wherein the pressure release button is configured to mechanically move when a force is applied to the pressure release button.

5. The cooler of claim 1, wherein the plunger is able to move within the outside air exhaust or intake channel when the pressure release assembly is activated to cause the opening to be unblocked.

6. The cooler of claim 1, comprising a vacuum pump assembly disposed in a sidewall of the enclosure or in the lid of the cooler for the removal of air within the enclosure.

7. The cooler of claim 1, wherein at least one sidewall of the cooler comprises a radiation reflecting material.

8. The cooler of claim 1, comprising at least one gripping handle disposed on a portion of the lid for manually covering or uncovering the enclosure with the lid.

9. The cooler of claim 8, wherein the at least one gripping handle is located on the lid in a location that is proximate to the pressure release assembly when the lid is in the closed position.

10. The cooler of claim 1, wherein the seal formed between the lid and the enclosure is an airtight seal.

11. The cooler of claim 1, comprising a first handle and a second handle each disposed on opposite sides of the cooler to allow the cooler to be lifted.

12. The cooler of claim 1, wherein the enclosure includes a thermally insulative material.

13. A cooler, comprising:

a container and a lid to enclose a product storage area within the container, the lid forming a seal with a top section of the container surrounding the product storage area of the cooler when the lid is in a closed position due to a pressure differential between an interior of the cooler and an exterior of the cooler, wherein the lid and the container are insulated, and wherein the cooler is capable of maintaining a temperature differential between the interior of the cooler and the exterior of the cooler; and a pressure release assembly operable to neutralize the pressure differential between an outside of the cooler and the product storage area when enclosed.

14. The cooler of claim 13, wherein the pressure release assembly includes:

means for selectively blocking and allowing air from the outside of the cooler into the product storage area through the opening.

15. The cooler of claim 14, wherein the means for selectively blocking and allowing the air includes an opening on a side thereof to allow the air from the outside of the cooler to enter into the means for selectively blocking and allowing the air.

16. The cooler of claim 13, wherein the pressure release assembly includes:

a channel through which outside air may enter the product storage area of the cooler, means for blocking air from flowing between the outside of the cooler and the product storage area through the channel, and a button coupled to the means for blocking the air, the button configured to move when a force is applied to the button to cause the means for blocking the air to move and allow the air to flow between the outside of the cooler and the product storage area through the channel.

17. The cooler of claim 16, wherein the pressure release assembly includes means for driving the means for blocking the air to move when the force is applied to the button.

18. The cooler of claim 13, wherein the pressure release assembly includes:

an outside air exhaust or intake channel through which outside air may enter the product storage area of the cooler, a plunger including a shaft, the plunger selectively movable with respect to an opening at one end of the outside air exhaust or intake channel to allow air from the outside of the cooler to enter the product storage area through the opening, and a pressure release button coupled to the plunger.

19. The cooler of claim 18, wherein the pressure release assembly includes a spring configured to apply a force to the plunger to retain the plunger in a blocking position to provide an air stop to the outside air exhaust or the intake channel.

20. The cooler of claim 13, comprising means for lifting the cooler.

* * * * *